United States Patent [19]

Wolf

[11] Patent Number: 4,655,604

[45] Date of Patent: Apr. 7, 1987

[54] PLANAR OSCILLATORY STIRRING APPARATUS

[75] Inventor: Martin F. Wolf, San Jose, Calif.

[73] Assignee: The United States of America as represented by the Administrator of the National Aeronautics and Space Administration, Washington, D.C.

[21] Appl. No.: 765,991

[22] Filed: Aug. 15, 1985

[51] Int. Cl.[4] ..... B01F 11/00

[52] U.S. Cl. ..... 366/219; 384/12; 494/84

[58] Field of Search ..... 366/219, 237, 238, 240, 366/208, 209, 210, 211, 216, 218; 494/84; 384/109, 12

[56] References Cited

U.S. PATENT DOCUMENTS

| | | | |
|---|---|---|---|
| 3,601,372 | 8/1971 | Harmes | 366/219 |
| 3,658,393 | 4/1972 | Luthi | 384/12 |
| 4,109,319 | 8/1978 | Brandt | 366/219 |
| 4,417,770 | 11/1983 | Tucker | 384/12 |
| 4,560,213 | 12/1985 | Enderle | 384/12 |

*Primary Examiner*—Robert W. Jenkins

*Attorney, Agent, or Firm*—Joseph H. Beumer; John R. Manning; Leon D. Wofford, Jr.

[57] ABSTRACT

Apparatus (11) for applying planar oscillations to a container (13). Pressurized air (99) is supplied to a moveable slide plate (27) which employs arms (19) having an air bearing vent structure (29, 31) which allows the slide plate to float and to translate. The container (13) to be oscillated is secured to the upper surface of the slide plate (27). A motor (39) driven rotating eccentric shaft (59) loosely extends into a center hole bearing (37) of the slide plate (27) to cause the oscillations.

17 Claims, 5 Drawing Figures

PLANAR OSCILLATORY STIRRING APPARATUS

ORIGIN OF INVENTION

This invention was made with U.S. Government support under Contract NAS8-34872 awarded by the National Aeronautics and Space Administration. The Government has certain rights in this invention.

TECHNICAL FIELD

This invention relates to an apparatus for applying planar oscillations, and more particularly to an apparatus for applying horizontal perpendicular oscillations to a sealed container such as a Bridgman crystal growth crucible.

BACKGROUND ART

In crystal growth from solution, stirring has been a vital part of the crystallization process. The major benefit is that the solution is homogenized, so that regions of locally high solute concentration where new crystals might nucleate (even in the presence of seed crystals or of crystals grown in the initial stages) can be avoided. In addition, the stirring action reduces the inhomogeneity in supersaturation between the face centers and edges, and so favors the growth of well facetted crystals rather than a tendency towards dendritic growth.

Efficient stirring is easily accomplished in many simple open systems like those used for aqueous solution growth, by the insertion of a rod fitted with a paddle and rotated about a vertical axis. Glass rods are widely used for this purpose in commercial crystallizers. There are, however, several systems for which this simple technique is not possible. These include open systems in which finding a stirrer which is not attacked by the liquid is difficult and closed systems in which volatile reactive materials are held in sealed containers.

An effective method for stirring liquids in sealed containers is the accelerated crucible rotation technique in which the container is periodically accelerated and decelerated, and the sense of the accelerated rotation may be reversed. The technique has been recognized as a valuable tool in crystal growth, particularly for the growth of magnetic garnet crystals from lead salt solvents in sealed platinum containers.

STATEMENT OF THE INVENTION

It has been discovered that low frequency, orthogonal oscillations applied horizontally to a Bridgman crucible provides a very rigorous stirring action, comparable with and often more effective by an order of magnitude than the accelerated crucible rotation technique. The stirring is particularly effective when coupled low frequency oscillations are applied at right angles so that there is simultaneous movement of the crucible in both horizontal directions.

To accomplish the discovery, a unique planar motion air bearing support for a sealed container has been made. The air bearing support has a moveable slide plate sandwiched between two fixed parallel support plates. Pressurized air is supplied to the moveable slide plate which employs a tri-arm air bearing vent structure which allows the slide plate to float and to translate between the parallel support plates. The container to be orthogonal oscillated is secured to the upper surface of the slide plate through an aperture in the upper support plate. The slide plate is provided with a center bearing hole which receives an eccentric cam shaft fixed to a motor shaft that extends through a small aperture in the lower support plate. The eccentric shaft does not interfere with the vertical float of the side plate.

Accordingly, it is an object of the present invention to provide an apparatus for stirring using planar orthogonal axes oscillations.

Another object is to provide an apparatus that given relatively harmonic-and-noise-free planar orthogonal axes oscillations.

Yet another object is to provide a apparatus that applies controlled perpendicular oscillations to a sealed container that is free from microphonic and other unwanted oscillations.

A further object is to provide a planar motion air bearing support that is capable of supporting a large mass at the end of a long moment arm.

DETAILED DESCRIPTION OF THE INVENTION

Figure 1:
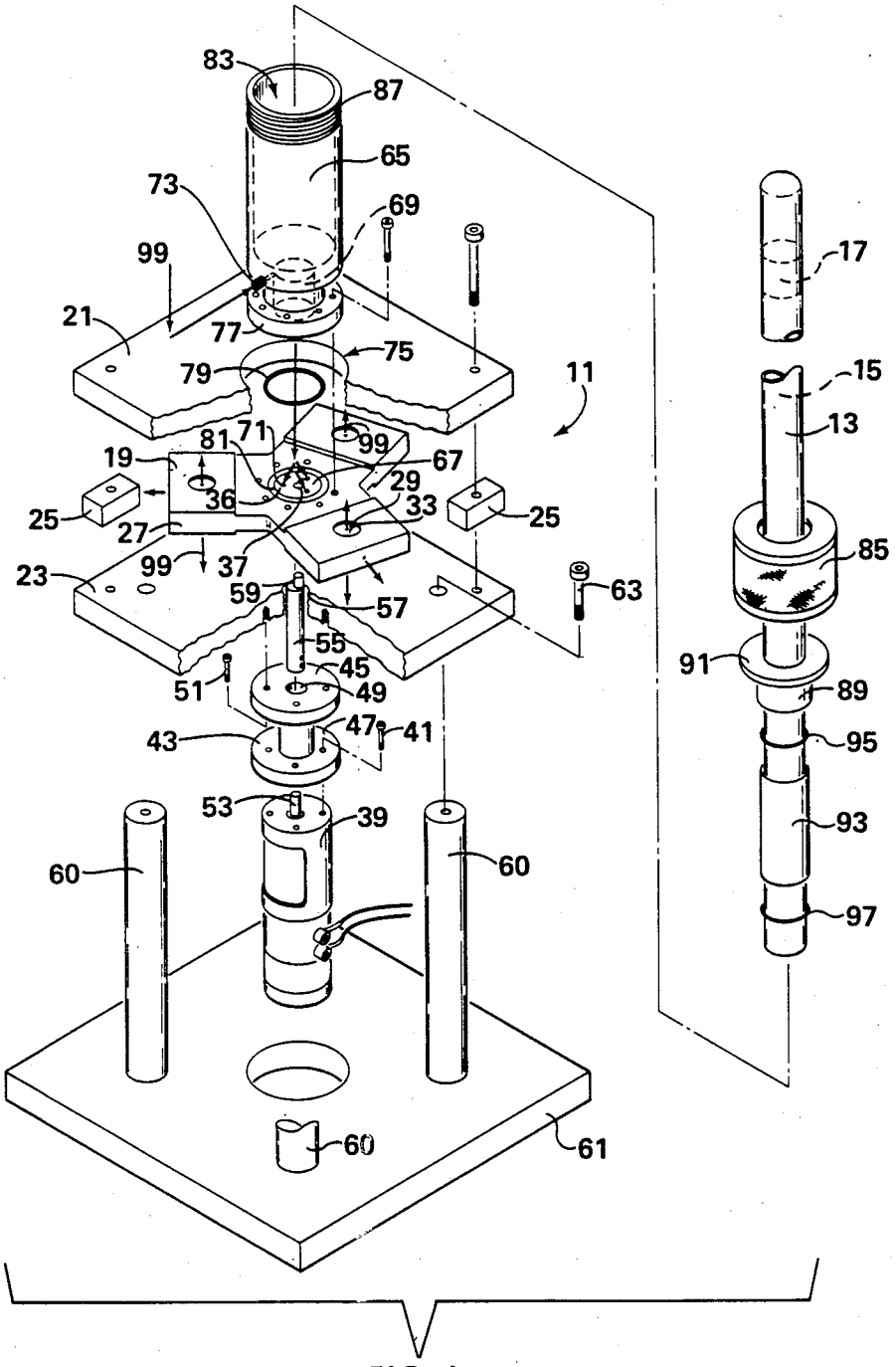
FIG. 1 is an exploded view of the apparatus according to the present invention, portions removed for clarity.
Figure 2:
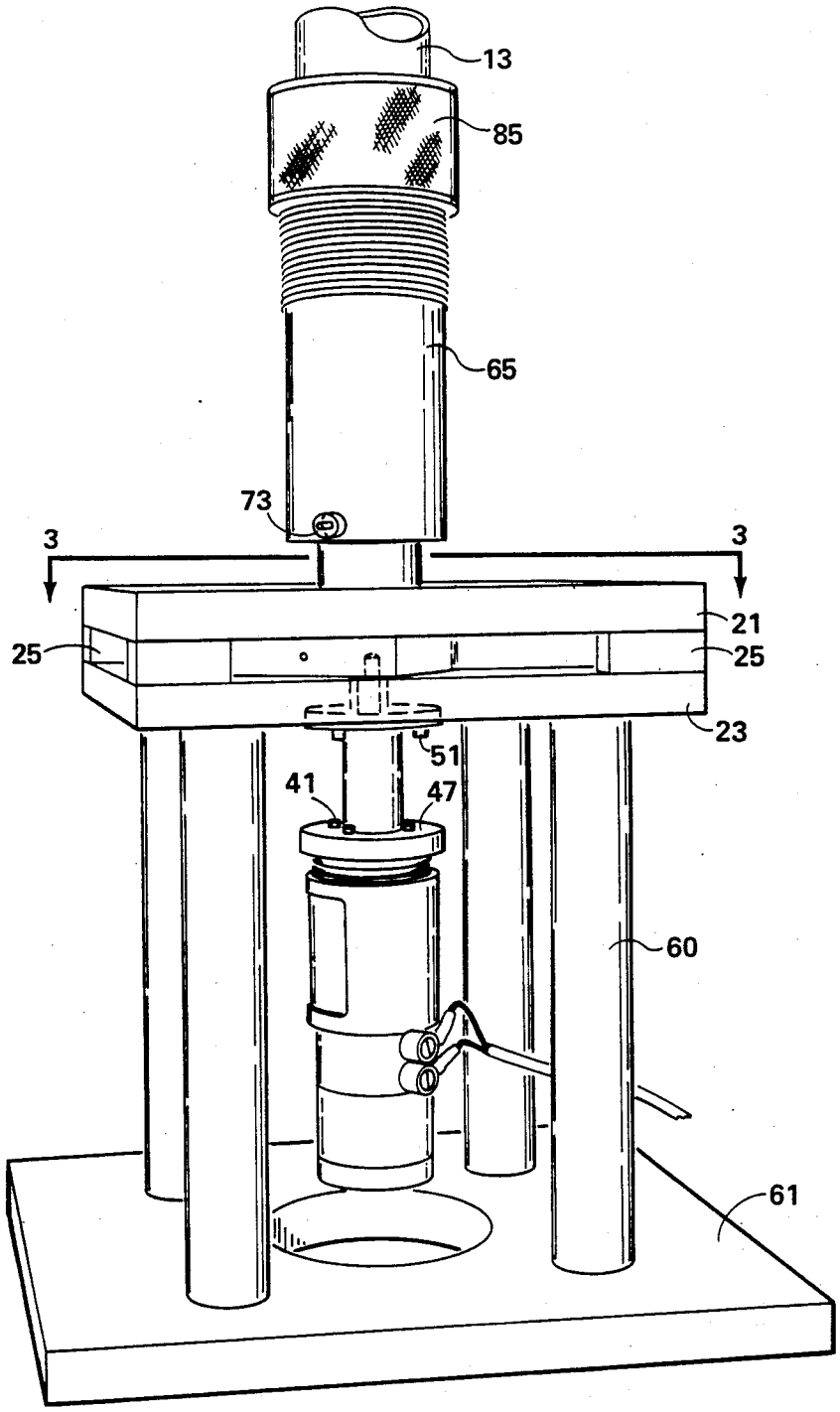
FIG. 2 is a side view of the apparatus in assembled relationship.
Figure 3:
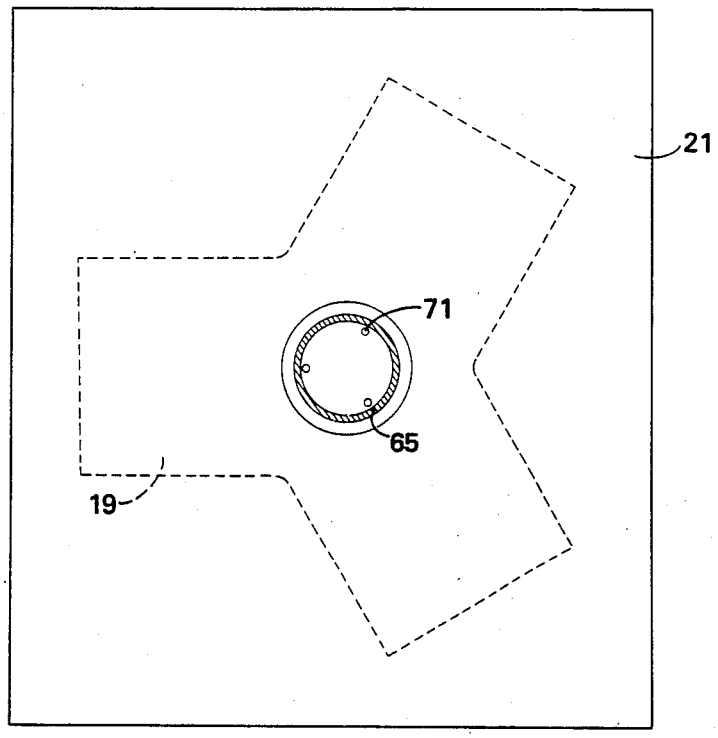
FIG. 3 is a top view of the air bearing component of the apparatus of FIG. 1.
Figure 4:
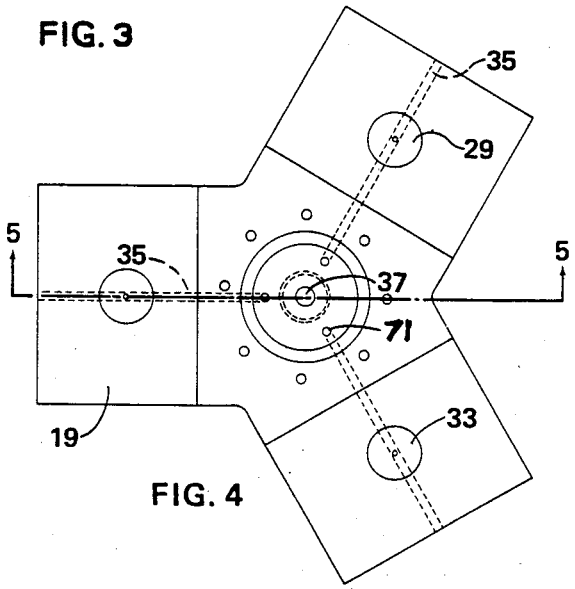
FIG. 4 is a top view of the tri-arm slide showing air bearing depressions.

Referring to the drawings, particularly FIG. 1, there is shown the planar motion air bearing support 11 of the present invention with an elongated sealed container or crucible 13 fixed thereto. The sealed container 13 is adapted to have therein a liquid 15 utilized in crystal growth 17. A particular stirring action is applied to the liquid 15 by the motion of the air bearing support 11 to obtain improved crystal quality.

Figure 5:
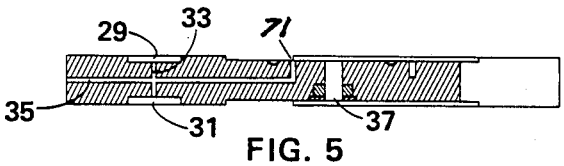
FIG. 5 is a sectional view along line 5—5 of FIG. 4.

The air bearing support 11 has a three arm structure slide plate 19 that is sandwiched between two fixed parallel support plates 21, 23. The separation by block dividers 25 of the parallel support plates 21, 23 is such as to provide standard air bearing tolerances from each side of the slide plate of approximately 0.001 inch. Midway of the length of each arm 27 of the slide plate 19 is an upper and lower circular air bearing recess 29, 31 (see FIG. 5) each of which has a center air outlet hole 33 which communicates with an internal arm passageway 35 that extends from the arm end back to the center area of the slide plate 19 and communicates with a distinct air inlet hole 71 in the upper central portion 36.

In FIG. 1 is shown the small electric motor 39 (Electrocraft Model 586B) that is fastened by bolts 41 to an adapter spool member 43 that has upper and lower flanges 45, 47 and a central passageway 49. The motor 39 is fastened by bolts 47 to the lower flange 47. The upper flange 45 is secured by bolts 51 to the lower support plate 23. The motor shaft 53 is secured by set screws to an extension shaft 55 which rotates within the central passageway 49 of the spool member 43. The extension shaft 55 extends through a hole 57 in the lower support plate 23. The upper end of the extension shaft 55 has an off-center axis dowel/cam 59 which extends loosely within the center axis hole bearing of the slide plate 19 (See FIG. 5) as not to interfere with its vertical float. Therefore, as the extension shaft 55 is rotated by the motor 39 the slide plate 19 is acted upon by the eccentric dowel 59 causing the floating plate 19 to oscillate along planar orthogonal axes. The air bearings 31 assures very low frictional movement of the slide plate 19 with good stiffness so as to adequately support the elongated sealed container 13.

The fixed parallel support plates 21, 23 are supported by posts 60 from a base member 61. Four posts one at each corner of the support plates 21, 23 are provided. The posts 60 are secured to the base plate 61 and the lower support plate 23 by bolts 63 or other equivalent devices.

Referring again to FIG. 1, there is shown the upper adapter support member 65 for securing the seal container 13 to the upper, central area 67 of the slide plate 19. The support member 65 has a separate lower air plenum chamber 69 which communicates with the three air inlet holes 71 of the slide plate 19. A standard hose fitting (Swageloc) 73 extending through the side wall of the member 65 permits air to be forced into the plenum chamber 69. The upper support plate 21 has a large central hole 75 which permits the orthogonal oscillation of the slide member 19 within the range caused by the rotation of the off-axis dowel 59. To cause the slide to vibrate ⅛ inches in the X and Y planes with a phase relationship of 90 degrees have been found to be satisfactory in providing the needed stirring action.

The upper support member 65 has a lower circular flange which is bolted to the upper surface of the slide plate 19. An O-ring 79 fits within a groove 81 in the face of the slide plate 19 beneath the flange 77 when assembled so as to seal against air leaks from the plenum chamber 69.

The upper portion of the support member is tubular and pipe-like and is adapted to receive the lower end of the elongated sealed glass container 13. The sealed container 13 is cylindrical and has an outer diameter smaller than the inner diameter of the upper opening 83 of the support member 65 so as to permit the use of a clamping means which includes a cap 85 which is screwed onto the upper threaded portion 87 of the support 65. The cap 85 has a central opening through which the sealed container 13 extends. The clamping means shown in FIG. 1 includes an upper cylindrical tubular member 89 with a flange 91 that the cap member 85 acts against, and another lower tubular cylindrical member 93 that encircles the lower portion of the seal container 13. Two O-rings 95, 97 are used, one 97 between the lower cylindrical member 93 and the bottom of the end of the container 13, and another 95 between the lower and upper tubular cylindrical members 89, 93. The upper and lower tubular cylindrical members 89, 93 act as compressors when assembled. As the cap 85 is screwed down on the threaded portion 87, the O-rings 95, 97 are trapped and compressed causing a capturing action against the elongated seal container 13.

In operation, the sealed elongated container 13 containing the crystal growth material 15 is clamped to the upper support member 65. Pressurized air 99 is supplied through the fitting 73 to the lower separate air chamber 69 within the support 65 which air flows in the direction of the arrows 99 shown in FIG. 1 to provide adequate support for the slide plate 19. Then, the motor 39 is turned on which causes the floating slide plate 19 to slide and to vibrate in a planar manner with a phase relationship of 90° describing a circle.

It is evident that the floating slide plate 19 may easily be modified for rotation movement by not using an off-set dowel 59 and simply securing the center axis of the slide plate 19 to the shaft extension 55.

It has been found that the invention described is capable of supporting a large mass at the end of a long moment arm, and to be free from microphonic and other unwanted oscillations. Mixing time of the crystal growth liquid using the invention exceeds the other techniques herebefore used.

While the invention has been described relative to a specific embodiment, it is evident that modifications and changes may be made with regard thereto without departing from the scope of the invention.

What is claimed is:

1. An apparatus for stirring comprising:

a slide plate adapted to be planar oscillated in two orthogonal directions about a central axis, said slide plate having central support area uniformly spaced about said central axis, a container fixed to said central support area, means for oscillating said slide plate about said central axis two parallel support plates, one on each side of said slide plate, said slide plate having equally spaced extending arms, each said arm having air bearing means for supporting said slide plate in a low friction manner between said support plates, means for supplying pressurized air to each said air bearing means.

2. An apparatus according to claim 1, further comprising:

a support means for fastening said container to said slide plate, said support means being fastened at one end to the central support area of said slide plate and having means at its other end to hold the container;

3. An apparatus according to claim 2, further comprising:

said slide plate having internal passageways communicating said air bearing means with at least an upper opening within the central support area, said support means having a lower chamber in communication with said upper openings, said means for supplying pressurized air includes a fitting for supplying air to said lower chamber of said support means.

4. An apparatus according to claim 3 further comprising:

said container being an elongated cylindrical tube adapted for containing a liquid for crystal growth, said support means including a clamping means for clamping said elongated cylindrical tube.

5. An apparatus according to claim 4 further comprising:

said means for oscillating said slide plate having a rotating eccentric means that engages said slide plate at its central axis.

6. An apparatus for stirring, comprising:

a slide adapted to be vibrated in a single plane about a central axis, a rotating eccentric means for vibrating said plate in said single plane and permitting said plate to float in a direction perpendicular to said single plane, said slide having a central face and about said central axis for supporting a container, upper and lower fixed plates on each side of said slide, said slide having a plurality of air bearing means spaced away from its face area so as to cause the slide to float on a cushion of air and provide substantial stiffness to turning moments.

7. An apparatus according to claim 6 further comprising:

an adaptive member screwed to said central face area of said slide, said adaptive member having a lower chamber which is sealed at its lower end by said central face, said slide having internal passageways opening at said central face and communicating with said lower chamber, air supply means for supplying air to said lower chamber and thereby through said internal passageways to said air bearing means.

8. An apparatus according to claim 7 further comprising:

said slide having a plurality of extending arms and said air bearing means are located along the length of said arms.

9. An apparatus according to claim 8 further comprising:

each said air bearing means comprising a circular depression having a central air outlet in the bottom thereof.

10. An apparatus according to claim 7 further comprising:

said rotating eccentric means comprising a motor secured to one of said fixed plates and having a cam dowel eccentric to said central axis and which rotates about said central axis, said cam dowel loosely extending into a center hole within said slide whereby said slide may float between said fixed plates and along said central axis and be planar vibrated by rotation of said cam dowel about said central axis.

11. An apparatus according to claim 10 further comprising:

said adaptive member having an upper tubular portion for receiving a cylindrical container, a clamping means for securing a cylindrical container within said tubular portion.

12. An apparatus according to claim 11 further comprising:

said clamping means comprising a tubular cap acting upon tubular cylindrical members with interspersed O-rings that cause the O-rings to compress and expand against the cylindrical container when the tubular cap is screwed down on the said tubular portion.

13. An air bearing for supporting loads having a substantial moment arm, comprising:

a slide adapted to float along a vertical axis and be driven in a plane perpendicular to said vertical axis, upper and lower fixed plates on each side of said slide between which said slide is adapted to float, said slide having an upper central face area adapted to support a load thereon, said upper fixed plate having a central opening to permit a load to extend to said upper face area and be secured thereto, said slide having a plurality of air bearing means on its upper and lower surfaces which acts against said upper and lower fixed plates to cause the slide to float therebetween, said air bearing means being spaced away from said upper central face area to provide substantial stiffness to turning moments caused by a load acting upon said upper central face area, and means for supplying air to said air bearing means.

14. An air bearing according to claim 13 further comprising:

motor means for driving said slide for planar movement between said fixed plate.

15. An air bearing according to claim 14 further comprising:

said motor means having a rotating eccentric cam member and said slide having a central hole loosely receiving said eccentric cam member.

16. An air bearing according to claim 14 further comprising:

an adaptive member secured to said upper central face area for securing a load thereto, said adaptive member having a lower chamber that is sealed at its lower end by said upper central face area, passageways within said slide communicating said air bearing means with said lower chamber of said adaptive member, air inlet means communicating with said lower chamber for supplying air thereto.

17. An air bearing according to claim 16 further comprising:

said adaptive member having an upper tubular portion for receiving the lower portion of an elongated container and, securing means on said upper tubular portion for tightly holding said lower portion of an elongated container.

* * * * *